US005332189A

United States Patent [19]

Tseng

[11] Patent Number: 5,332,189

[45] Date of Patent: Jul. 26, 1994

[54] FASTENER OF CONSTRUCTION MOLDBOARD

[76] Inventor: Cheng-Tzu Tseng, 3R 2th Fl, No. 6, Ta-An West St, Taichung, Taiwan

[21] Appl. No.: 974,947

[22] Filed: Nov. 12, 1992

[51] Int. Cl.[5] ..... E04G 17/065

[52] U.S. Cl. ..... 249/40; 249/190; 249/213; 249/216; 249/217; 249/219.1

[58] Field of Search ..... 249/217, 216, 219.1, 249/134, 190, 38, 43, 46, 40, 42, 213

[56] References Cited

U.S. PATENT DOCUMENTS

| | | | |
|---|---|---|---|
| 1,680,923 | 8/1928 | Williams | 249/219.1 |
| 1,781,601 | 11/1930 | Rohaut et al. | 249/217 |
| 3,013,323 | 12/1961 | Williams | 249/217 |
| 3,095,093 | 9/1975 | Williams | 249/217 |
| 4,054,258 | 10/1977 | Holmboe | 249/217 |
| 4,363,462 | 12/1982 | Wlodkowski et al. | 249/190 |
| 4,640,490 | 2/1987 | Wilson | 249/217 |

FOREIGN PATENT DOCUMENTS

| | | | |
|---|---|---|---|
| 2422224 | 11/1975 | Fed. Rep. of Germany | 249/217 |

*Primary Examiner*—Khanh Nguyen
*Attorney, Agent, or Firm*—Pro-Techtor International

[57] ABSTRACT

An improved moldboard fastener includes mainly one ore more inner pull rod, two shower heads, two outer pull rods, two washers and two nuts. The shower head is made integrally of a concrete material having a great strength and is composed of a rod body having inner threads. The rod body, which is enclosed in the shower head, extends outwards for an appropriate length and comprises a flange extending in a direction opposite to an end of the shower head in such a manner that the flange is aligned with the end of the shower head. The inner pull rod is located between and fastened to the two shower heads while the two outer pull rods are fastened respectively to another ends of the two shower heads. The inner pull rod, two shower heads and two outer pull rods are held securely in place by means of the two washers and the two nuts. Upon the completion of the pouring operation of the concrete into the space defined by the moldboards, the inner pull rod and the shower heads are left in the concrete wall so built.

5 Claims, 5 Drawing Sheets

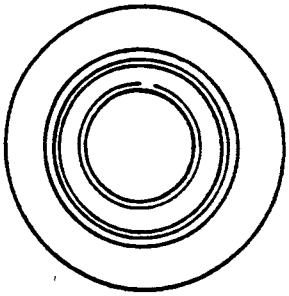
FIG. 1-A (PRIOR ART)
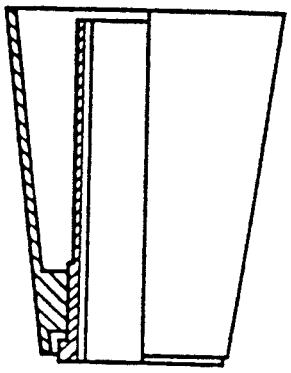
FIG. 1-B (PRIOR ART)
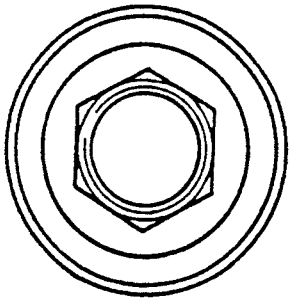
FIG. 1-C (PRIOR ART)

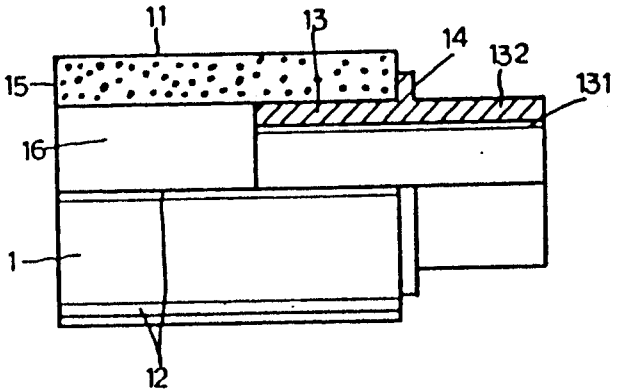
FIG. 4-B
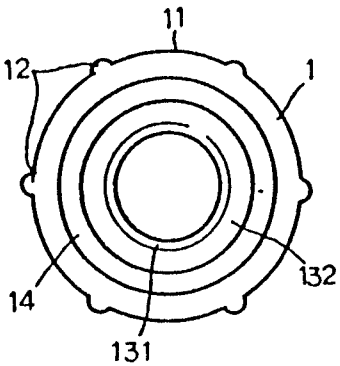
FIG. 4-C
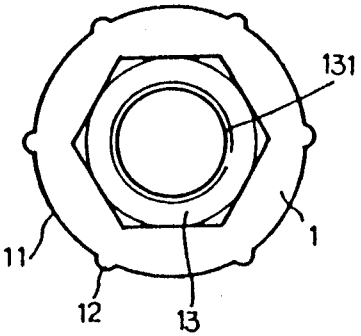
FIG. 4-A

FASTENER OF CONSTRUCTION MOLDBOARD

BACKGROUND OF THE INVENTION

The present invention relates to a construction moldboard, and more particularly to a fastening device of the construction moldboard.

The prior art moldboard cotter has the shortcomings, which are expounded explicitly hereinafter.

As shown in FIGS. 1 and 2, the prior art moldboard cotter is provided with a shower head located between an inner bolt rod and an outer bolt rod. Such shower head is made of a plastic material and is removed upon the removal of moldboards after the completion of the grouping of concrete. The removal of the shower head often results in a gap caused by the loosening of the inner bolt rod, as designated by the letter "H" in FIG. 2, in view of the fact that the shower head is fastened by means of threads. In addition, the loosened inner bolt rod can even become detached from the concrete wall and fall on the ground. An incident that the rainwater finds its way into the gap to cause the so-called wall cancer takes place frequently.

Furthermore, the removal of the shower head is done manually. Such manual removal of the shower head is expensive and harzardous to the safety of a worker doing such work at a construction site. In addition, the removal of the shower head is done only after the concrete has become completely dry or at least partially dry. Such long waiting period can be often aggravating and inconvenient.

SUMMARY OF THE INVENTION

It is, therefore, the primary objective of the present invention to provide a moldboard fastener with a shower head which is made integrally and is made of a strong concrete material. The shower head encloses therein a rod having an inner thread and having a flange extending toward the head portion of the shower head. Located between the rod and the shower head is an inner pull rod. Located at the other end are two outer pull rods. With the cooperation of two nuts and two washers, the fastener is able to hold securely the moldboards between which the concrete is poured. upon the completion of removing the moldboards, the shower head of a reinforced concrete material unites securly with the poured concrete. In other words, the shower head of the present invention is not removed so that the inner pull rod is not loosened to bring about a crevice in the wall. Therefore, the fastener of the present invention is especially suitable for use in building an underground reinforced concrete wall, a water pond reinforced concrete wall, a reinforced concrete wall of a concealed ditch, and a reinforced concrete wall of a tunnel.

The foregoing objectives, features, structures and functions of the present invention will be better understood by studying the following detailed description of a preferred embodiment of the present invention, in conjunction with the drawings provided herewith.

BRIEF DESCRIPTION OF THE DRAWINGS

FIG. 1A, 1B and 1C show schematic plan views of a shower head of a moldboard cotter of the prior art.

FIG. 4A, 4B and 4C shows an exploded view of the moldboard fastener of the present invention.

DETAILED DESCRIPTION OF THE INVENTION

Figure 2:
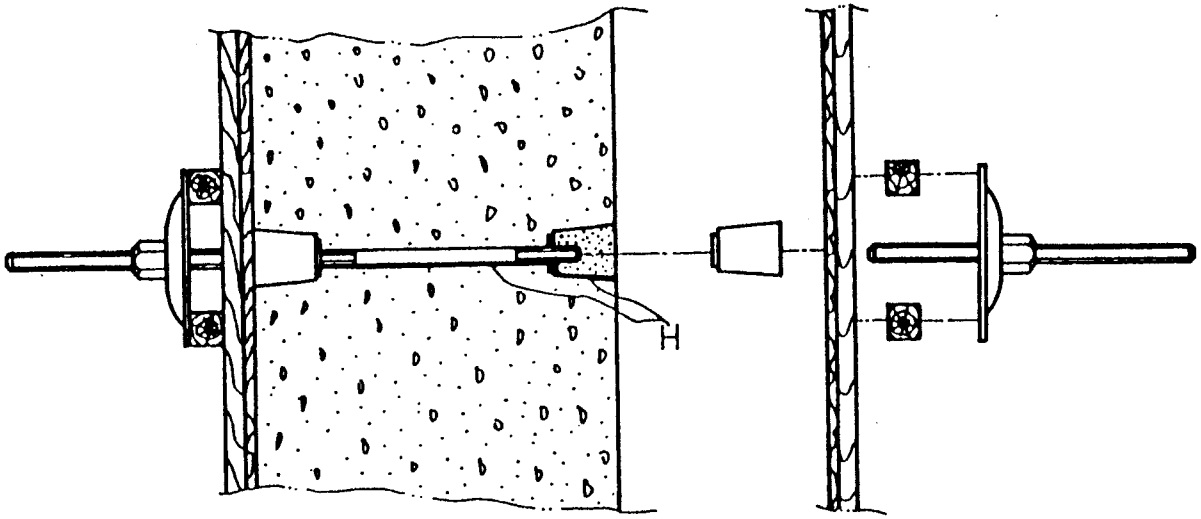
FIG. 2 (PRIOR ART)
FIG. 2 shows a schematic view of the prior art moldboard cotterin use.
Figure 3:
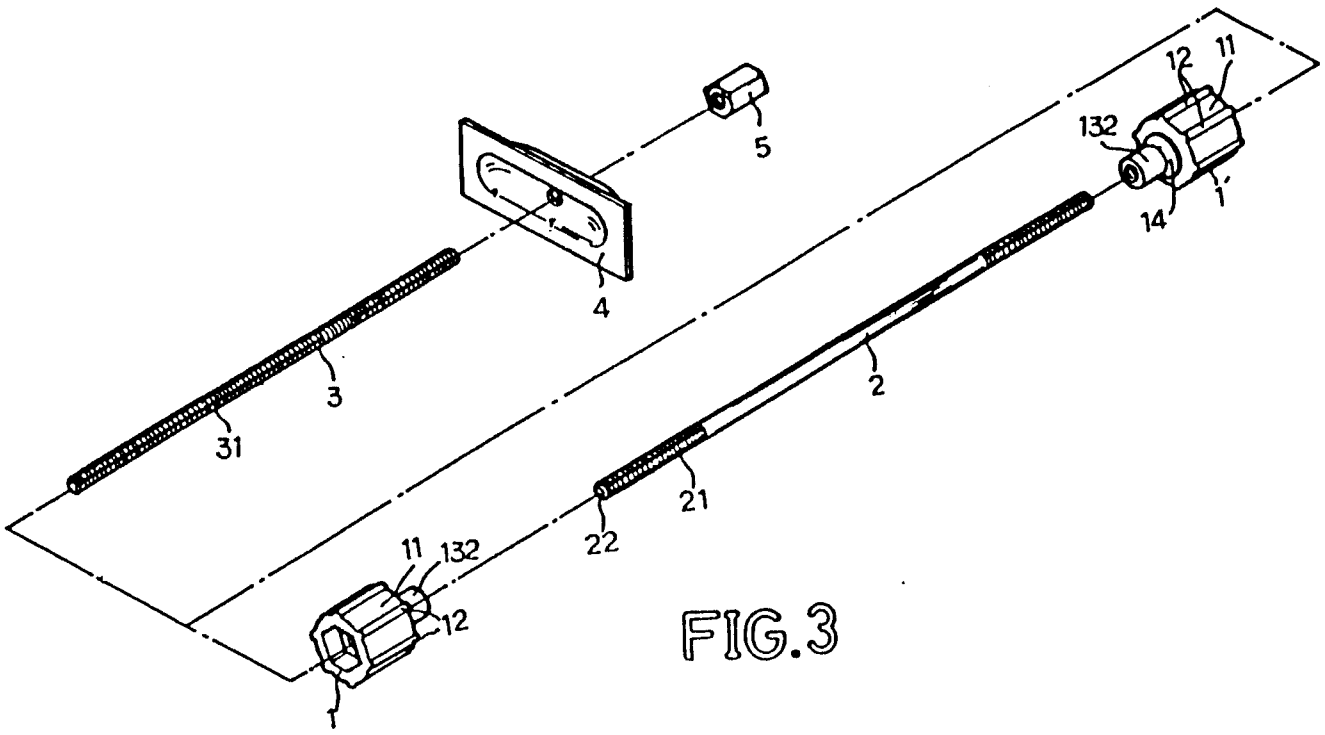
FIG. 3 shows a schematic plan view of a shower head of a moldboard fastener of the present invention.
Figure 6:
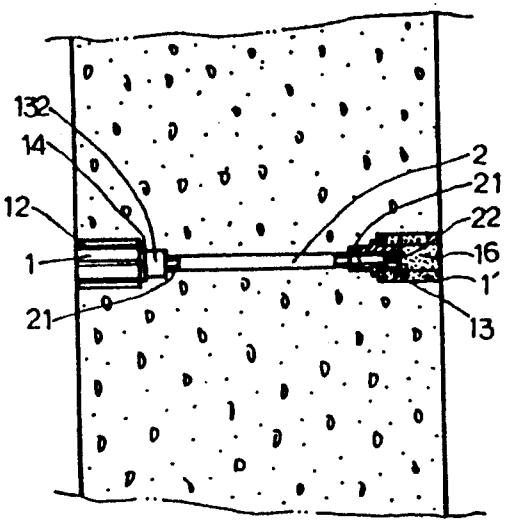
FIG. 6 shows a schematic view of another preferred embodiment of the present invention.
Figure 5:
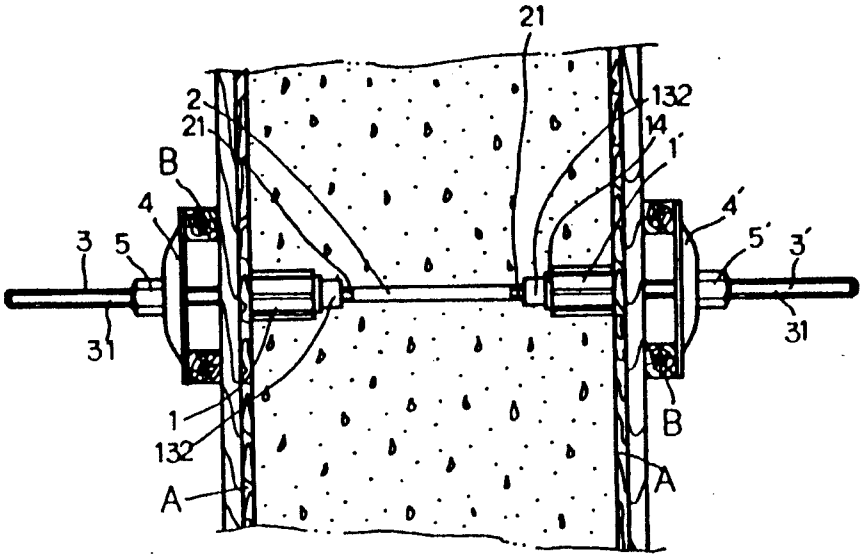
FIG. 5 shows a schematic view of a preferred embodiment of the present invention.

Referring to FIGS. 3–5, a moldboard fastener of the present invention is shown to comprise mainly a shower head 1, an inner pull rod 2, an outer pull rod 3, a washer 4, and a nut 5. The shower head 1 is made integrally of a concrete material of a great strength and is provided on the outer surface 11 thereof with a plurality of the protruded strips 12 arranged in a radiating manner. In addition, the shower head 1 encloses therein a rod body 13 having inner threads 131. The rod body 13 extends outwards for an appropriate length 132. In addition, the rod body 13 comprises a flange 14 located on the portion thereof near the shower head 1 and aligned with the end of the shower head 1. Another side of the rod body 13 is provided with a recess 16 which remains an appropriate distance from the bottom end 15 of the shower head. The application of the present invention is illustrated in FIG. 5. The flanges 14 of the shower heads 1 and 1' are arranged in a manner that they are opposite to each other. An inner pull rod 2 is provided with two threaded segments 21 located respectively on both ends thereof for engaging the inner threads 131 of the rod bodies 13 enclosed in the shower heads 1 and 1' respectively. Another ends of the shower heads 1 and 1' are coupled respectively with two outer pull rods 3 and 3' which have pierced through the moldboards A. The coupling of the outer pull rods 3 and 3' with the shower heads 1 and 1' is accomplished by the threads 31 of the outer pull rod 3, which engages the inner threads 131 of the rod body 13. If necessary, a plurality of angle materials B are arranged outside the moldboards A and are subsequently pressed against respectively by washers 4 and 4', which are turned into the outer pull rods 3 and 3' in order to hold securely the angle materials B and the moldboards A, with the help of two nuts 5 and 5'. Upon the completion of pouring the fresh concrete into the space formed by the moldboards A, the outer pull rods 3 and 3', two washers 4 and 4', and two nuts 5 and 5' are removed before the moldboards A and the angle materials B are removed, with the shower heads 1 and 1' remaining in the poured concrete. In the meantime, the prior art problem of crevice caused by the movement of the inner pull rod is effectively averted, without adversely affecting the basic structural integrity of the concrete wall, as shown in FIG. 6.

The shower head 1 is provided with a plurality of the protruded strips 12 which are radiantly arranged on the outer surface 11 of the shower head 1 for enhancing the combining effect of the shower head 1 with the concrete so as to prevent the shower head 1 from being loosened at such time when an attempt is made to disengage the threads 31 of the outer pull rods 3 and 3' with the inner threads 131 of the rod bodies 13 enclosed respectively in the shower heads 1 and 1'. In addition, upon the removal of the outer pull rod 3 from the concrete wall, the recess 16 of the shower head 1 is filled with the cement mixture to prevent the rod body 13 of the shower head 1 and the tip 22 of the inner pull rod 2 from being so exposed as to make direct contact with the water and the air which find their ways into the concrete wall. In other words, such set-up prevents the rod body 13 of the shower head 1, the tip 22 of the inner pull rod 2 and the reinforcing steel bars of the concrete wall from rusting. The shower head 1 of the present invention may be circular, or triangular, or polygonal in its cross section, depending on the requirements of the construction work.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the hereinafter appended claims.

What is claimed is:

1. A fastener of construction moldboard comprising:

an inner pull rod, at least two shower heads constructed of high strength concrete, at least two outer pull rods, at least two washers, and a plurality of nuts; wherein the construction moldboard is held in place by the inner pull rod arranged between and fastened to the shower heads, and with the outer pull rods being fastened to the shower heads by the washers and the nuts; and wherein the fastener includes a rod body received within a hollow area in the shower heads, the rod body being received in the hollow area and extending beyond an inner surface of the shower head; and the rod body includes threads adapted for engaging with the inner and outer pull rods.

2. The fastener of claim 1 wherein:

the shower heads include a plurality of protruding strips arranged about the circumference of the shower head.

3. The fastener of claim 1 wherein:

the shower heads have a substantially circular, square, triangular, or polygonal cross section.

4. The fastener of claim 1 wherein:

the rod body includes a flange located so as to be in contact with and to align with the inner surface of the shower head.

5. The fastener of claim 1 wherein:

a recess is defined in the hollow area of the shower head between an outer end of the rod body and an outer end of the shower head.

* * * * *